US006422232B1

(12) United States Patent
Ashton et al.

(10) Patent No.: US 6,422,232 B1
(45) Date of Patent: Jul. 23, 2002

(54) HEATER WITH LIGHT

(75) Inventors: Jerald Ashton; Clyde Schulte, both of Wichita; Randall L. May, Andover, all of KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/579,994

(22) Filed: May 26, 2000

(51) Int. Cl.[7] ..... F21V 33/00; F24C 15/22
(52) U.S. Cl. ..... 126/92 B; 362/93; 362/253
(58) Field of Search ..... 126/92 B, 92 AC, 126/259 R; 362/253, 179, 182, 92, 93; 431/100, 111, 344

(56) References Cited

U.S. PATENT DOCUMENTS 3,020,384 A 2/1962 Murphy et al.
3,251,356 A * 5/1966 Prince et al. ..... 126/92 B
5,533,892 A * 7/1996 Long ..... 431/344
5,964,233 A * 10/1999 Clark et al. ..... 135/16
6,102,031 A * 8/2000 Waters ..... 126/92 AC

FOREIGN PATENT DOCUMENTS

DE 2023734 * 11/1970 ..... 126/92 B
EP 976979 A1 * 2/2000
JP 09303784 A * 11/1997
WO W098/58211 12/1998

* cited by examiner

*Primary Examiner*—Sara Clarke
(74) *Attorney, Agent, or Firm*—Kramer, Levin, Naftalis and Frankel LLP

(57) ABSTRACT

A heater provides both radiant heat and light. The heater provides radiant heat via a heater assembly which includes a gas burner heating a screen; the screen in turn provides radiant heat. The heater includes a light assembly which may provide light by, for example, burning gas fuel, or by other means such as electricity. The heater may include a heat reflector which can be removed and compacted or disassembled for storage.

36 Claims, 10 Drawing Sheets

HEATER WITH LIGHT

FIELD OF THE INVENTION

The present invention relates to gas fuel heaters. In particular, the present invention relates to a gas fuel heater providing both heat and light and having a compact reflector.

BACKGROUND INFORMATION

Conventional radiant gas fuel heaters provide heat by burning fuel such as propane or butane. An example of such a radiant heater is the 5045 Radiant Heater available from the Coleman Corporation.

Conventional gas fuel heater designs include a refillable and/or possibly a removable fuel storage tank, a fuel delivery. apparatus, and a gas ring or burner plate for burning the gas. The fuel delivery apparatus provides an air/fuel mixture to the gas ring or burner plate, and may include a regulator and other equipment, such as an operator fuel flow controller. The regulator accepts fuel, such as gas, from a fuel source and provides a steady, controlled fuel stream of constant pressure as an output. The fuel source may be a removable, portable fuel storage tank, or may be a permanent supply line from another suitable fuel source.

The gas ring expels an air/fuel mixture in a ring shaped pattern, and the air/fuel mixture burns. A conical or cylindrical metal grid extends upwards from the area of the gas ring. As a result, the metal grid is heated, possibly to the point of glowing, and emits radiant heat, thereby providing radiant heat to objects (including people) nearby. In such a design a heat reflector typically sits above the metal grid, to reflecting the heat provided by the grid downward and laterally. The heat reflector itself may be substantially heated and may emit radiant heat on its own. The portion of the heater holding the heated metal grid and heat reflector may be raised by a post to a height of, for example, six or seven feet above the ground, allowing heat to radiate downward and outward from a point above the level of users' heads.

The heat reflector in such a design includes a metal disk having a curved or concave shape. Such reflectors may be set-up and shipped as one set-up unit. If the gas heater is shipped partially disassembled (with, for example, the reflector removed) such a heat reflector takes up a relatively large amount of space in the shipping carton. Such a heat reflector may be, for example, three feet in diameter.

Conventional gas fuel heaters do not provide light and thus when used in the evening must be accompanied by a separate lighting source if lighting is desired. Various types of lighting apparatuses exist. For example, a conventional gas burning lantern provides light to a user by burning gas at a burner tube covered with a mantle. Fuel may be provided to the burner tube by a fuel delivery apparatus, similar to the fuel delivery apparatus of the gas heater described above. As fuel passes through the fuel delivery path it mixes with air. The air/fuel mixture flows to burner tube and mantle. When ignited with a air/fuel mixture provided by the fuel delivery apparatus, the mantle emits a bright light. The mantle in such a lantern contains a light emitting element, which converts the heat from the flame into light. Examples of conventional gas burning lanterns include adjustable gas lanterns manufactured by The Coleman Company of Wichita, Kans.

Other types of lighting apparatuses are well known—e.g., appliances that burn fuel such as kerosene, or which use electricity supplied by batteries or electric current from a home supply.

The need for heaters and lighting apparatuses is often co-extensive. Heat is often required at night. Often heat and light are required at the same time in places (such as back yards or patios) which may be inconvenient to heat via methods used indoors (e.g., central heat and electric light). However, the typical solution to such needs is to provide separate devices—e.g., a separate heating unit and a separate lighting unit. The use of separate units presents inefficiencies and takes up substantial space.

It would be desirable to have a gas fuel heater which includes a heat reflector which, when not in use or when being shipped, is relatively compact. It would be desirable to have a unit which provides both heat and adequate light. It would be desirable to have such a unit where the heat and light providing portions operate off the same fuel or power supply.

SUMMARY OF THE INVENTION

A heater according to a preferred embodiment of the present invention provides both radiant heat and light. The heater provides radiant heat via a heater assembly which includes a gas burner heating a screen; the screen in turn provides radiant heat. The heater also includes a light assembly which may provide light by, for example, burning gas fuel, or by other means such as electricity. Preferably, the heater includes a heat reflector which may be removed and compacted or disassembled for storage.

DETAILED DESCRIPTION OF THE INVENTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well known features may be omitted or simplified in order not to obscure the present invention.

Figure 1:
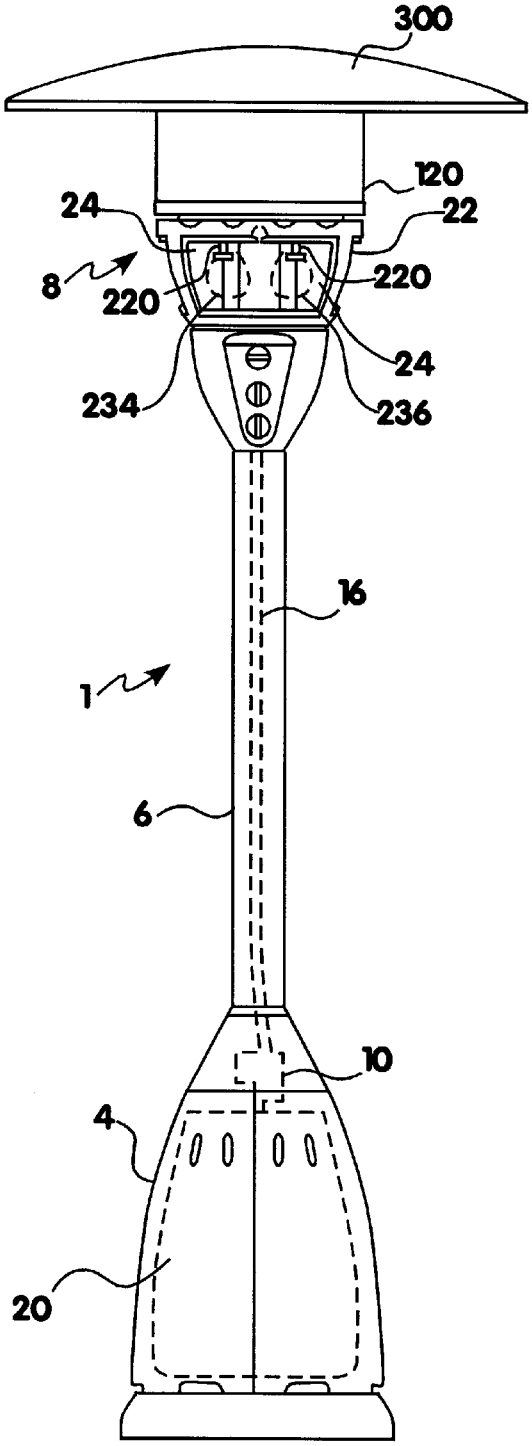
FIG. 1 illustrates a heater according to an exemplary embodiment the present invention.
Figure 1A:
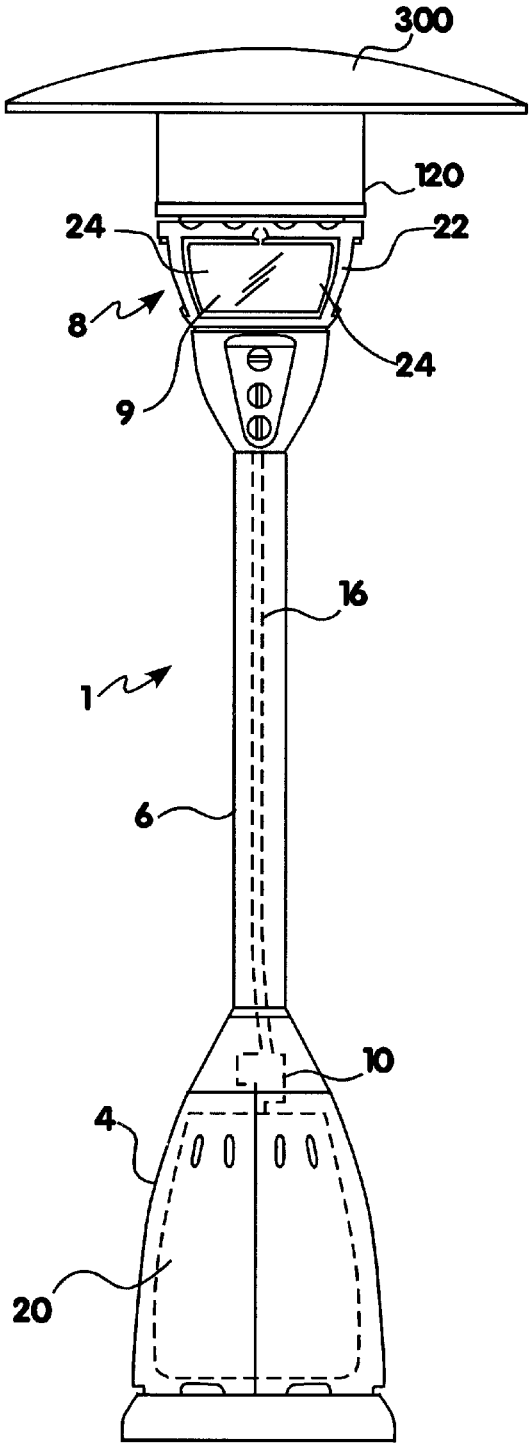
FIG. 1A illustrates a heater with an electric light assembly according to an exemplary embodiment of the present invention.

FIG. 1 illustrates a heater according to an exemplary embodiment of the present invention. Referring to FIG. 1, the heater 1 includes a base cabinet 4, a support pole 6, and a heat and light assembly 8. The heat and light assembly 8 includes an apparatus selectively providing, for example, heat and/or light to a user. In a preferred embodiment, the heat and light assembly 8 includes a burner plate 118 (FIGS. 2 and 3) and cylindrical grid 120, for providing heat, and a lantern burner tube 220 and two mantles 234 and 236, for providing light. Alternatively, as shown in FIG. 1A, an electric light assembly 9 may be used. A preferably removable and compressible or collapsible heat reflector 300 sits on top of the heat and light assembly 8 and reflects heat, and possibly light, downward and outward. Preferably, the heat reflector 300 is, for example, approximately three feet in diameter. The heat and light assembly 8 is located at a height of approximately seven or eight feet; other heights may be selected. A frame 22 surrounds the lantern burner tube 220 and mantles 234 and 236, and supports one or more clear panels 24 to allow light to be emitted from the mantles. The clear panels 24 are preferably glass panels, but may be constructed of other suitable materials.

In a preferred embodiment, the heater 1 includes a regulator 10, which accepts a flow of fuel from a fuel tank 20, and which provides a controlled flow of fuel to the heating elements and to the lighting elements via a fuel hose 16, which extends through the support pole 6. The fuel may be, for example, combustible gas such as propane, or may be other fuels. The regulator 10 is preferably of known construction. In operation, fuel flows from the fuel tank 20 to the regulator 10. The regulator 10 accepts a variable pressure input of fuel from the fuel tank 20 and outputs a relatively constant fuel flow of relatively constant pressure to the fuel hose 16. A filter (not shown) may be located near the bottom of the regulator 10. The fuel delivery system, which may include, for example, the fuel tank 20, the regulator 10, the fuel hose 16, and various valves and hoses, may include other combinations of components. For example, fuel may be supplied directly from a permanently installed outside line.

The fuel tank 20 may be of known construction and connects to the regulator 10 through known methods. The fuel tank 20 is preferably removable, refillable, and replaceable. For example, the fuel tank 20 may be a removable twenty pound propane cylinder. The base cabinet 4 may include a door allowing access to the interior of the base cabinet 4 for fuel tank replacement. Alternately, an external fuel supply may be attached to the heater 1 at, for example, the regulator 10.

Figure 2:
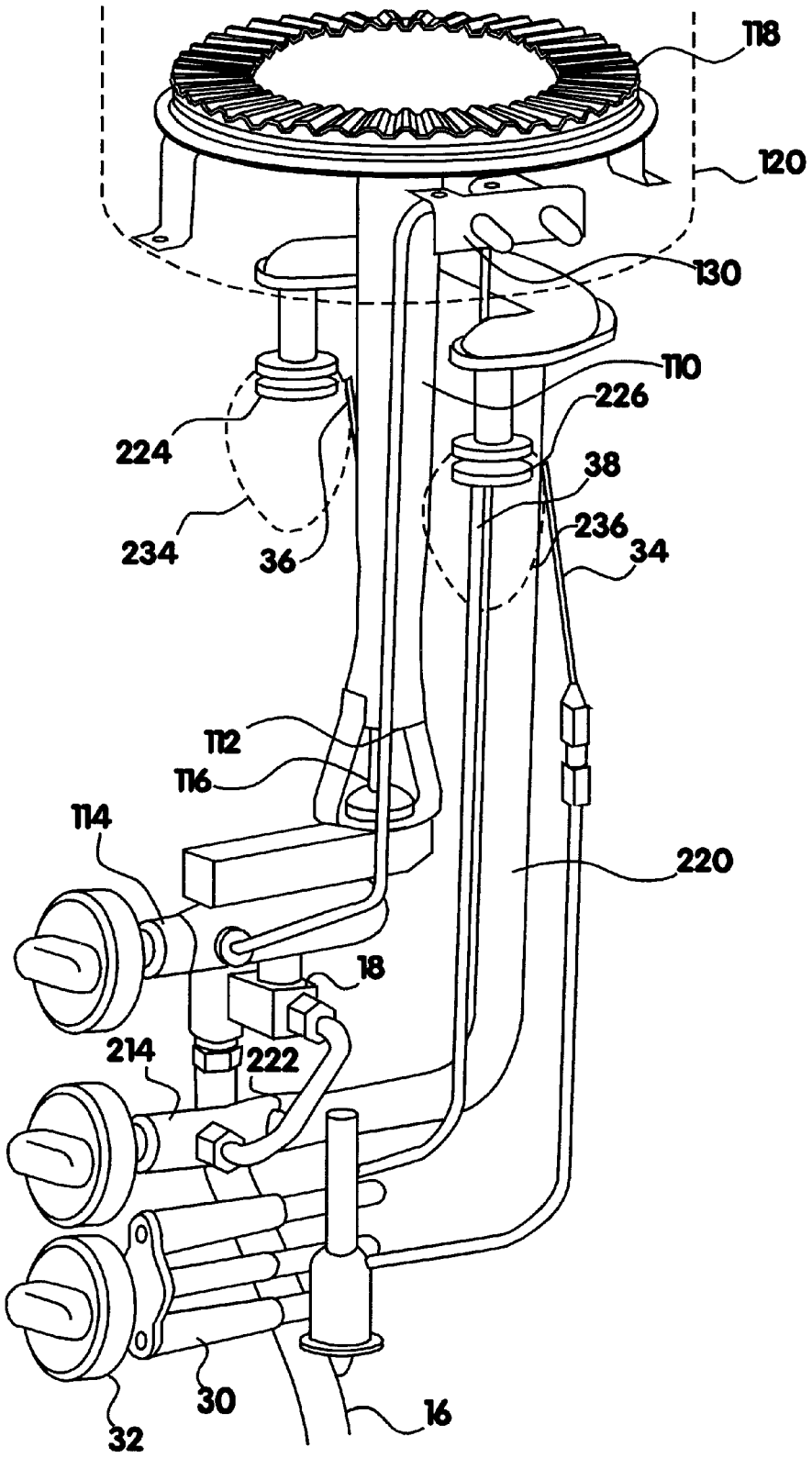
FIG. 2 illustrates the heat and light producing components of the embodiment of the heater of FIG. 1.
Figure 3:
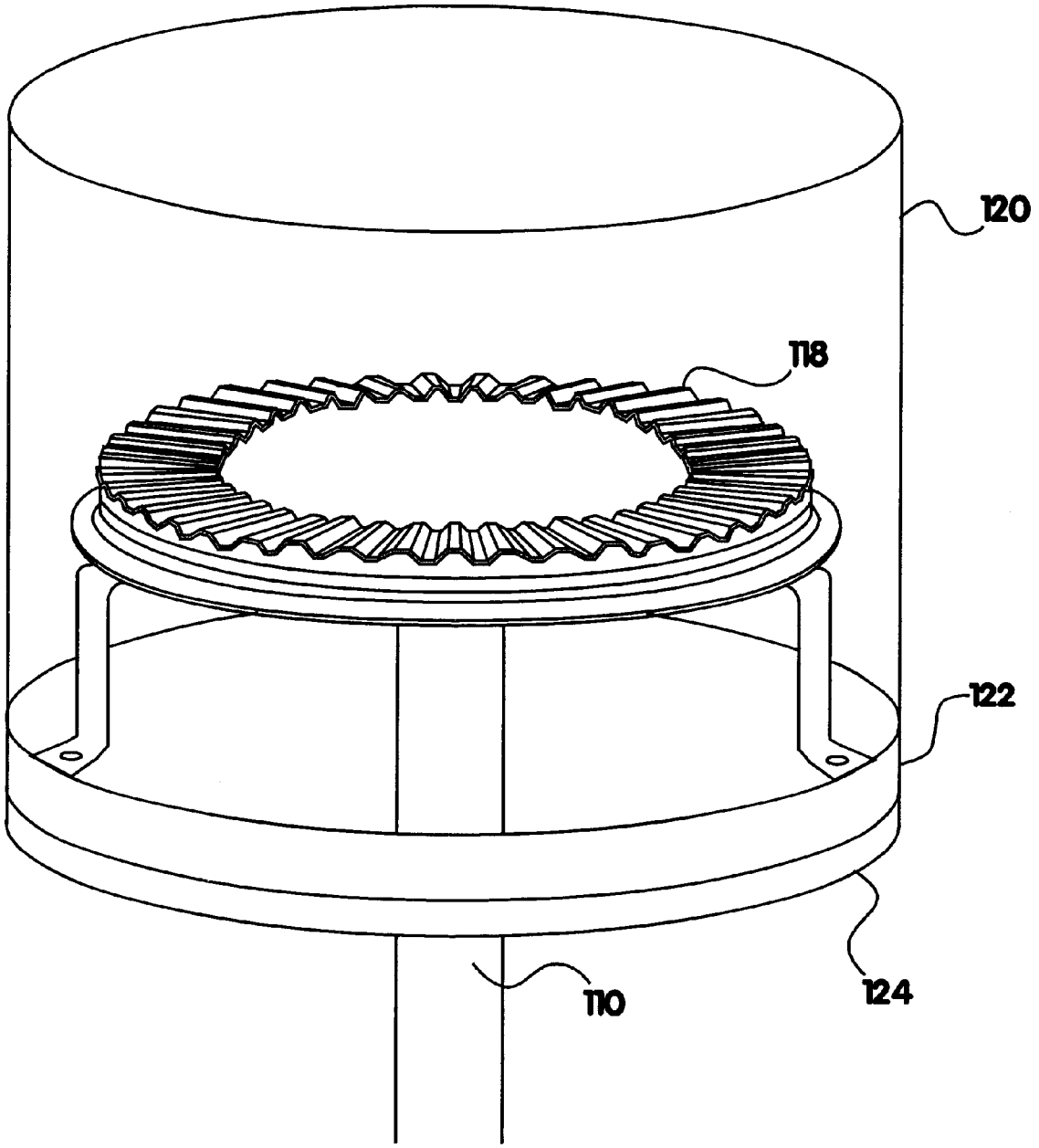
FIG. 3 illustrates a portion of the heat producing components of the embodiment of the heater of FIG. 1.

The individual heating and lighting components of the heater according to the present invention may be of known construction. FIG. 2 illustrates the heat and light producing components of the embodiment of the heater of FIG. 1. FIG. 3 illustrates a portion of the heat producing components of the embodiment of the heater of FIG. 1.

Referring to FIGS. 2 and 3, the fuel hose 16 supplies fuel to a T-valve 18. The T-valve 18 supplies the fuel to a heater valve 114 which supplies fuel to heater components, and to a light valve 214 which supplies fuel to lighting components. The heater valve 114 supplies fuel to, for example, a heater burner tube 110, which supplies an air/fuel mixture to the burner plate 118, and to a pilot light 130, which lights the burner plate 118. The heater burner tube 110 has an opening 112 near its bottom for accepting fuel and ambient air. A cylindrical grid 120 extends upwards from the area of the burner plate 118. A burner plate base 122 (FIG. 3), providing heat shielding, and supporting the grid 120, and a heat shield 124 (FIG. 3), shielding components of the heater 1 from the heat generated by the burner plate 118, lie beneath the burner plate 118.

In a preferred embodiment, the grid 120 is of known construction, and is, for example, a cylindrical grid or mesh approximately one foot high and approximately fourteen inches in diameter. The burner plate 118 is also of known construction and may be approximately six to eight inches in diameter. Alternately, the grid may be of other shapes, such as conical. Other radiant heat producing devices may be used. Preferably, the burner plate 118 is constructed from stainless steel and the grid 120 is preferably constructed from stainless steel; however, other suitable materials may be used.

In operation, fuel exits the heater valve 114 via a fuel jet 116 and enters the opening 112 in the burner tube 110; air is also drawn in to the opening 112. The air and fuel travel up the heater burner tube 110, mix in the burner tube 110, and exit at the burner plate 118. The air/fuel mixture expelled by the burner plate 118 burns, and the flames extend, for example, outward and upward from the burner plate 118 and thereby heating the grid 120. The grid 120 is heated, possibly to the point of glowing, and emits radiant heat, providing radiant heat to objects (including people) nearby. Some of the radiant heat is reflected outward and downward by the heat reflector 300 (FIG. 1). The heat reflector 300 itself may be substantially heated (to, for example, 600 degrees Fahrenheit) and may emit radiant heat of its own.

In a preferred embodiment, when shipped to a user, the heater 1 may be partially disassembled to reduce shipping volume and thus shipping costs. Preferably, the heat reflector 300 is removable, and may be shipped in the same carton as the rest of the heater 1, or may be shipped in a separate carton. Furthermore, the heat reflector 300 is partially collapsible to further reduce the space it takes up in any shipping carton. For example, preferably, the heat reflector 300 may be disassembled, folded or otherwise compacted for shipping.

In an exemplary embodiment, the light valve 214 supplies fuel to the lantern burner tube 220. The lantern burner tube 220 has one or more air holes 222 allowing air to enter the lantern burner tube 220 and to mix with the fuel. The air/fuel mixture flows up the lantern burner tube 220 and flows to two mantle holders 224 and 226, to which are attached two mantles 234 and 236. The air/fuel mixture is combusted at the mantles 234 and 236. Each mantle 234 and 236 then glows to provide light. The mantles 234 and 236 are implemented in a known way, such as a fabric impregnated with a light emitting element, such as a catalyst. Such mantles are available from The Coleman Company of Wichita, Kans. The mantles 234 and 236 are attached to the mantle holders 224 and 226 in a known way. For example, a mantle may be tied to a mantle holder with thread.

In one embodiment, a piezoelectric lighter 30 of known construction can be included in the heating and lighting components and provides a spark to the pilot light 130 and each of the mantles 234 and 236. For example, turning the knob 32 of the lighter 30 causes a hammer inside the lighter 30 to strike a crystal inside the lighter 30; the crystal provides current to each of the electrodes 34, 36 and 38, which provide a spark, through known methods.

To cause the heater 1 to provide heat, a user turns the heater valve 114 to supply fuel to the pilot light 130. The user then turns the knob 32 of the lighter 30, to provide electric current to the electrode 38. The sparks provided by the electrode 38 ignite the fuel flowing out of the pilot light 130. The user then turns the heater valve 114 to allow fuel to flow to the burner plate 118. The air/fuel mixture flowing out of the burner plate 118 is ignited by the pilot light 130. The heater 1 may also include well known features such as a mechanism preventing burner lighting if the pilot light is not also lit.

To cause the heater 1 to provide light, a user opens the light valve 214 to supply fuel to the lantern burner tube 220, in turn causing an air/fuel mixture to flow to the mantles 234 and 236. The user then turns the knob 32 of the lighter 30, to provide electric current to the electrodes 34 and 36. The sparks provided by the electrodes 34 and 36 ignite the fuel flowing to the mantles 234 and 236, heating the mantles 234 and 236 and causing the mantles 234 and 236 to glow.

The heater according to an embodiment of the present invention provides more flexible use and operation in that it may provide heat, light, or both to a user. By providing two fuel control valves the user may control the heat and light source separately. The heat and light providing elements may be powered by the same fuel source (e.g., a gas canister). Thus, separate heating and lighting units are not needed. Furthermore, the heat and light are provided from the same location.

In alternate embodiments the heating units and/or the lighting units may be powered by other fuel sources. For example, an electric lighting unit may be combined with a gas powered heating unit. In such a lighting unit power may come from batteries or from a home A/C line, and light may be provided by an electric bulb, for example a fluorescent bulb. In alternate embodiments, different arrangements of valves, controls or lightning devices may be used. For example, one valve may be used for both the heating and lighting elements, or valves may be integral with a regulator.

In certain embodiments of the present invention, the heater may include a heat reflector which may be shipped in a disassembled, folded or otherwise compacted manner to enable easier and more efficient shipping. In one embodiment, the heat reflector is circular or polygonal and includes a set of panels, each panel forming a section of the heat reflector. Preferably, each panel is a curved member having three sides: one outer side, forming the circular outside of the heat reflector; and two inner sides, corresponding to radii of the heat reflector.

Each inner side of a heat reflector panel includes, for example, a downward extension. Each downward extension mates with a downward extension of a neighboring panel to connect the panels. For example, the downward extensions may connect using friction fit tabs such as friction fit spring fasteners provided by the Tinnerman Company, or may connect using other suitable connectors. Each downward extension may include a shaped portion which corresponds to a shaped portion on a neighboring downward extension. Each panel also may include a shaped or cutout portion at the area where the two downward extensions join, in order to form a mounting hole near the center of the fully set-up heat reflector, so that the heat reflector may be mounted on the heater.

Figure 4A:
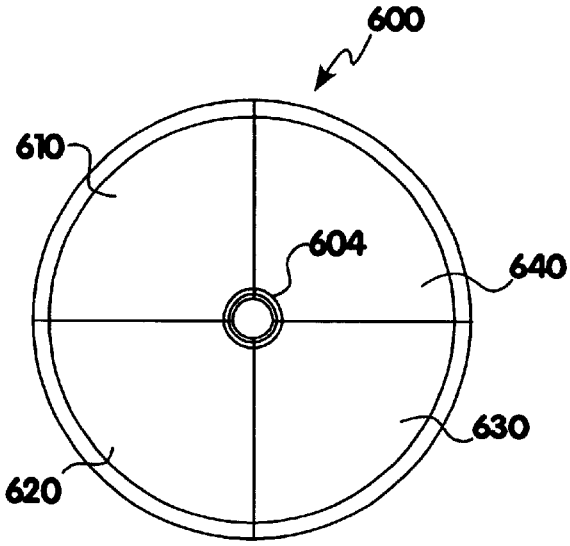
FIG. 4*a* illustrates a heat reflector of a heater according to an embodiment of the present invention.

FIG. 4*a* illustrates a heat reflector of a heater according to an embodiment of the present invention. Referring to FIG. 4*a,* the heat reflector 600 includes four panels 610, 620, 630 and 640, and a mounting hole 604, which may be used to attach the heat reflector 600 to a heater. Other numbers of panels may be used. When assembled, the heat reflector 600 may be mounted to a heater by fitting the hole 604 over an extension on the top of the heater; the extension may attach to the heat reflector 600 by friction fit, by being screwed on, or by other methods.

Figure 4B:
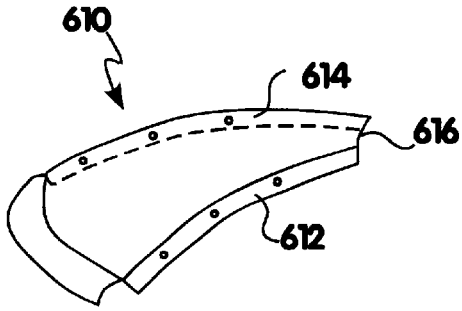
FIG. 4*b* illustrates a panel of the heat reflector of FIG. 4*a*.
Figure 4G:
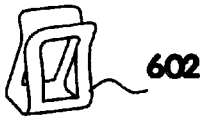
FIG. 4*g* illustrates a fastener of the heat reflector of FIG. 4*a*.
Figure 4C:
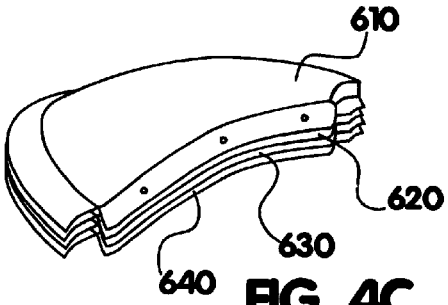
FIG. 4*c* illustrates the panels of the heat reflector of FIG. 4*a,* disassembled and stacked.

FIG. 4*b* illustrates a panel of the heat reflector of FIG. 4*a*. Referring to FIG. 4*b,* panel 610 includes downward extensions 612 and 614, and includes a shaped or cutout portion 616. Similarly, panels 620, 630 and 640 each include downward extensions 612 and 614 and cutout portion 616. The panels 610, 620, 630 and 640 may stack one on top of another in a compact manner. FIG. 4*c* illustrates the panels of the heat reflector of FIG. 4*a,* disassembled and stacked. FIG. 4*d* illustrates the heat reflector of FIG. 4*a,* substantially set-up. In the depiction of FIG. 4*d,* one panel 610 is removed. The heat reflector 600 is preferably constructed from aluminum, but may be constructed from other materials, such as steel.

Figure 4E:
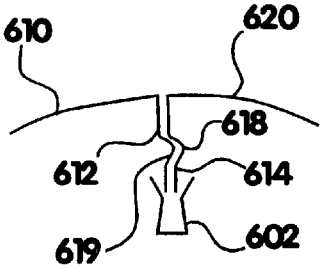
FIG. 4*e* illustrates portions of two heat reflector panels of the heat reflector of FIG. 4*a*.
Figure 4F:
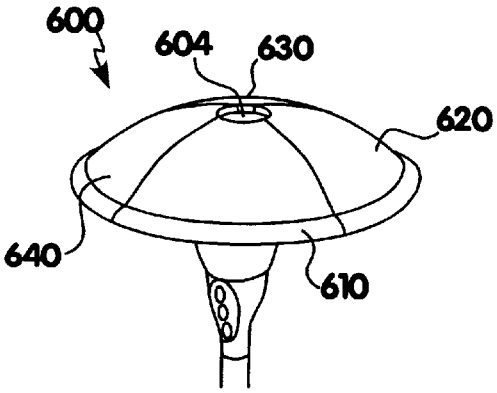
FIG. 4*f* illustrates the heat reflector of FIG. 4*a,* set-up and mounted to a heater.
Figure 4D:
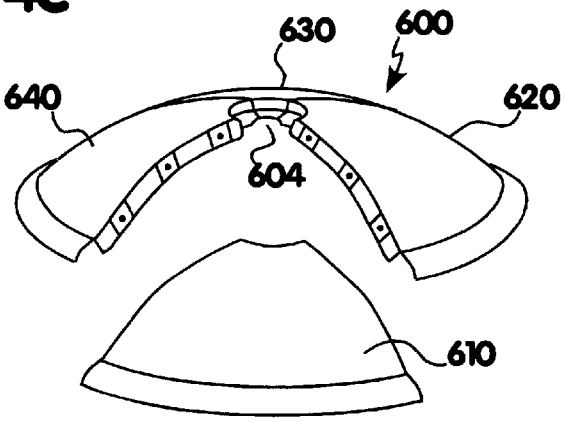
FIG. 4*d* illustrates the heat reflector of FIG. 4*a,* substantially set-up.

FIG. 4*e* illustrates portions of two heat reflector panels of the heat reflector of FIG. 4*a*. FIG. 4*g* illustrates a fastener of the heat reflector of FIG. 4*a*. Referring to FIGS. 4*e* and 4*g,* the downward extension 612 of the panel 610 is joined to the downward extension 614 of the panel 620 by, for example, a Tinnerman type fastener 602. The fastener 602 slides up over the downward extensions 612 and 614, and fits to the downward extensions 610 and 612 via a friction fit. Preferably, each adjacent panel 602 is connected by a plurality of such fasteners, for example three, connecting the downward extensions 612 and 614. Preferably, each downward extension includes grooves or indentations, such as indentations 618 and 619. Adjacent grooves or indentations 618 and 619 mate to enable easier connection of adjacent panels. FIG. 4*f* illustrates the heat reflector of FIG. 4*a,* set-up and mounted to a heater.

In a further embodiment, the heat reflector includes a set of panels, each panel hinged to the outside edge of a disk holder. The panels also may fold inward for storage, considerably reducing the surface area and storage area for the heat reflector. The panels may fold outward to expand the heat reflector to its operational size, in the manner of an opening flower or a common kitchen steamer. The heat reflector is then attached to the heater by attaching the disk to the heater.

Figure 5C:
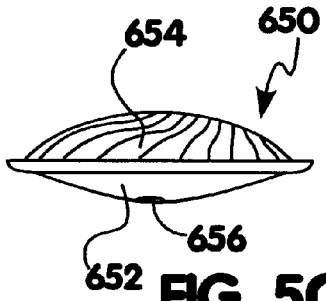
FIG. 5*c* illustrates the heat reflector of FIG. 5*a,* where the panels are folded inward for storage.
Figure 5B:
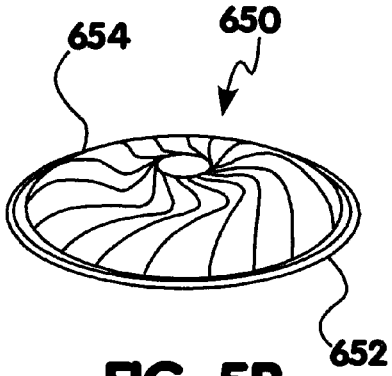
FIG. 5*b* illustrates the heat reflector of FIG. 5*a,* where the panels are folded inward for storage.
Figure 5A:
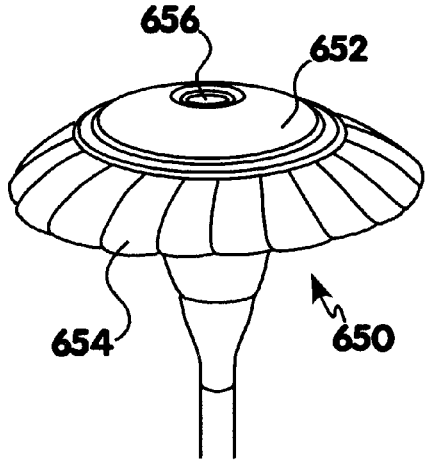
FIG. 5*a* illustrates a heat reflector of a heater according to another embodiment of the present invention, mounted to a heater.

FIG. 5*a* illustrates a heat reflector of a heater according to another embodiment of the present invention, mounted to a heater. Referring to FIG. 5*a,* the heat reflector 650 includes, for example, a preferably convex disk 652, to which are hingedly attached a plurality of panels 654. The disk 652 includes a cutout portion 656, by which the heat reflector 650 may be mounted to the heater. Each of panels 654 is preferably a quadrilateral panel which is curved to follow the shape of the disk 652. In alternate embodiments, the curve of the disk 652 or panels 654 may be different, or the disk 652 or the panels 654 need not be curved.

Figure 5D:
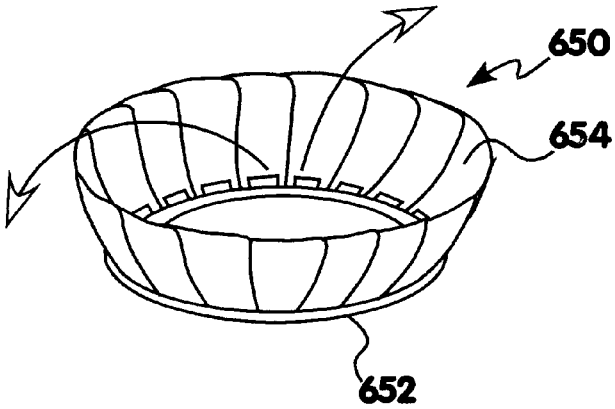
FIG. 5*d* illustrates the heat reflector of FIG. 5*a,* as the panels of the heat reflector are being folded outward.
Figure 5E:
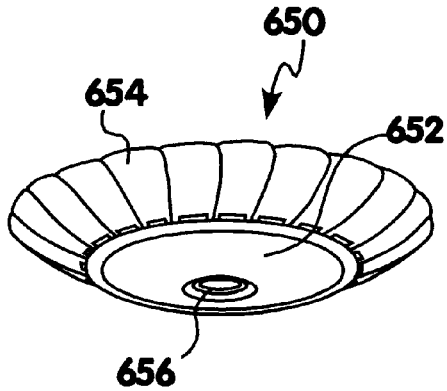
FIG. 5*e* illustrates the heat reflector of FIG. 5*a,* where the panels of the heat reflector are folded outward.

FIGS. 5*b* and 5*c* illustrate the heat reflector of FIG. 5*a,* where the panels are folded inward for storage. The panels 654 pivot on the disk 652 to fold inward to form a compact saucer shaped body. If the panels 654 and disk 652 are of different shapes, for example flat, the shape of the heat reflector 650 when folded is also different. FIG. 5*d* illustrates the heat reflector of FIG. 5*a,* as the panels of the heat reflector are being folded outward. FIG. 5*e* illustrates the heat reflector of FIG. 5*a,* where the panels of the heat reflector are folded outward. When the panels 654 open, the heat reflector 650 is inverted for mounting on the heater. The heat reflector 650 may be mounted to a heater by fitting the hole 656 over an extension on the top of the heater; the extension may attach to the heat reflector 650 by friction fit, by being screwed on, or by other methods. The heat reflector 650 is preferably constructed from aluminum, but may be constructed from other materials, such as steel.

In a further embodiment, the heat reflector includes a set of panels, each panel forming a section of the heat reflector, where the edges of adjacent panels slide over each other. Preferably, the heat reflector is circular or polygonal, and each panel is a curved member having three sides: one outer side, forming the outside edge of the heat reflector, and two inner sides, corresponding to radii of the heat reflector. If the heat reflector is circular, each outer side is curved. When fully set-up, each inner side mates with a inner side of a neighboring panel to connect the panels, possibly by overlapping and forming a lap joint. Each inner side of a heat reflector panel includes, for example, a set of attachment points, such as screw holes or friction fit points. One inner side of each heat reflector panel may include a raised portion acting as a stop and defining the limit of the distance which two attachment points may slide over each other.

Each panel also may include a shaped or cutout portion at the area where the two downward extensions join, so that when the heat reflector is set up a mounting hole is formed near the center of the up heat reflector. Using such a mounting hole, the set-up heat reflector may be mounted on the heater. A disk may be mounted over this mounting hole to further enable mounting to the heater. The disk may be mounted to the panels using, for example, screws, nuts and bolts, or by friction fit. When the heat reflector is disassembled, each panel may stack on top of one another; in such a manner the heat reflector takes up little storage space.

Figure 6A:
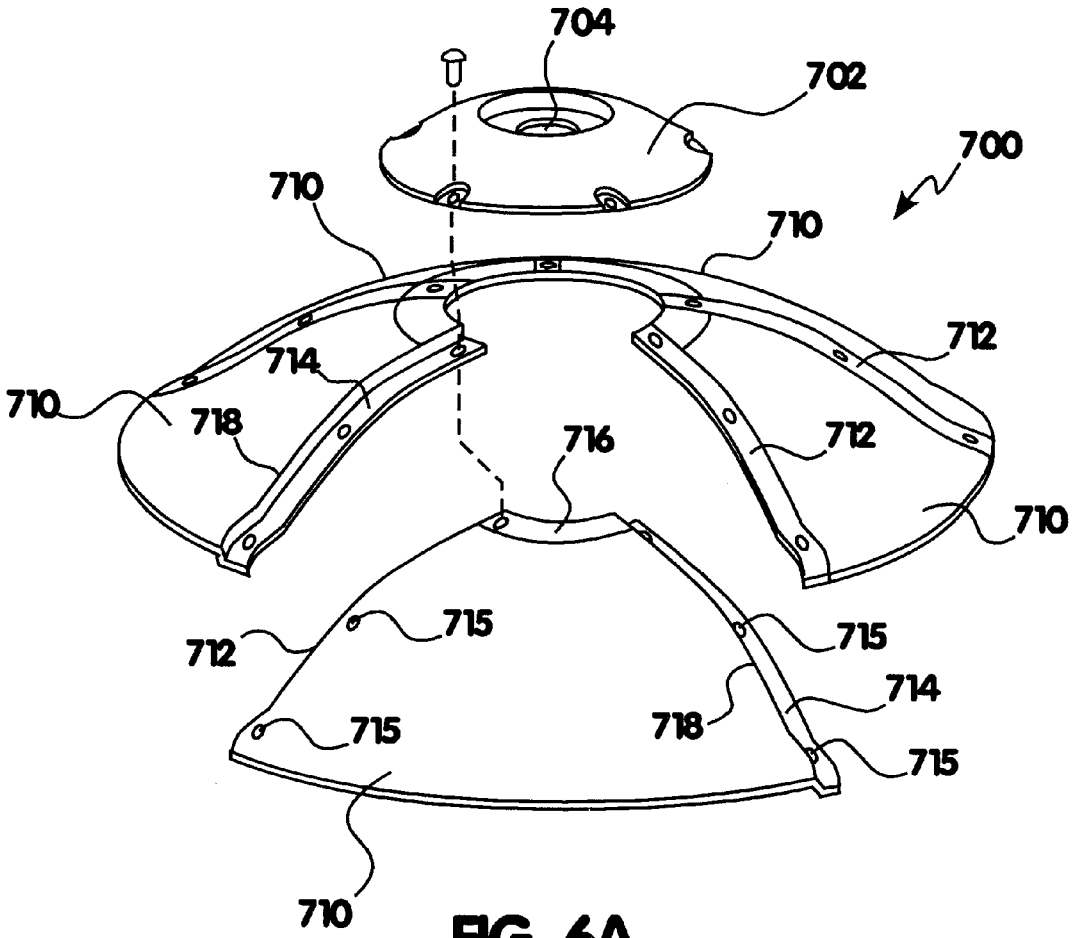
FIG. 6*a* illustrates a heat reflector of a heater according to another embodiment of the present invention.

FIG. 6*a* illustrates a heat reflector of a heater according to another embodiment of the present invention. Referring to FIG. 6*a,* the heat reflector 700 includes five panels 710 and a center disk 702. Other numbers of panels may be used, if desired. The center disk 702 mounts to the panels 710 via, for example, screws, nuts and bolts or rivets. Each panel 710 includes inner portions 712 and 714, each inner portion 712 and 714 having screw holes 715. One inner portion 714 of each panel 710 includes a lip 718. Each panel 710 includes a shaped or cutout portion 716; when the heat reflector is fully set-up the cutout portion 716 defines a mounting hole at which a center disk 702 may be mounted. The center disk 702 includes a mounting hole 704 which can be used for mounting on a heater. Preferably, each panel 710 is thin gauge steel, and preferably the center disk 702 is constructed of metal such as aluminum or steel and is thicker than the panels 710. In alternate embodiments, other suitable materials may be used.

Figure 6B:
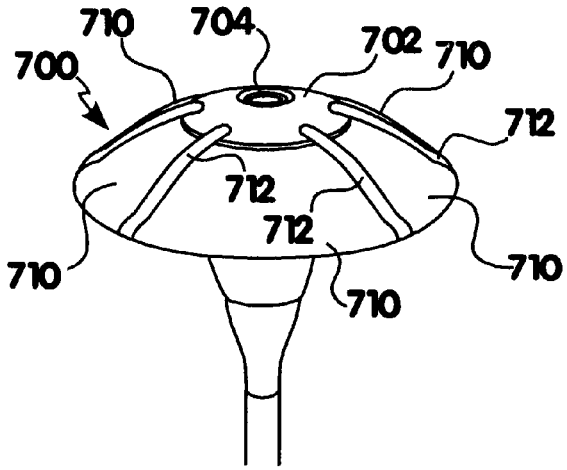
FIG. 6*b* illustrates the heat reflector of FIG. 6*a,* mounted to a heater.

To set-up the panels 710 into the heat reflector 700, the inner portions 712 and 714 of each adjacent panel 710 slide over each other and are connected by, for example, screws, nuts and bolts or rivets. Each lip 718 is preferably a raised ridge or extension and acts as a stop to define the limit by which the panels 710 may slide over each other. FIG. 6*b* illustrates the heat reflector of FIG. 6*a,* mounted to a heater. When set-up, the heat reflector 700 may be mounted to a heater by fitting the hole 704 over an extension on the top of the heater; the extension may attach to the heat reflector 700 by friction fit, by being screwed on, or by other methods.

In a further embodiment, the heat reflector is formed from of a set of panels surrounded by and connected by a frame, each panel forming a section of the heat reflector. In such an embodiment, the heat reflector may be, for example, circular or polygonal, and each panel is a flat member. The frame is formed from a set of frame members, each having a slot for holding one or more panels. The frame members join together by, for example, screws, nuts and bolts or friction fit, to form the frame and to hold the panels. Preferably, when the frame and panels are joined, a mounting hole or open portion is formed near the center of the fully set-up heat reflector so that the heat reflector may be mounted on the heater. A disk may be mounted over this hole to further enable mounting to the heater; this disk may in turn include a mounting hole. When disassembled, the panels, frame members, and disk may be stacked and stored to take up less space than the fully set-up heat reflector.

Figure 7A:
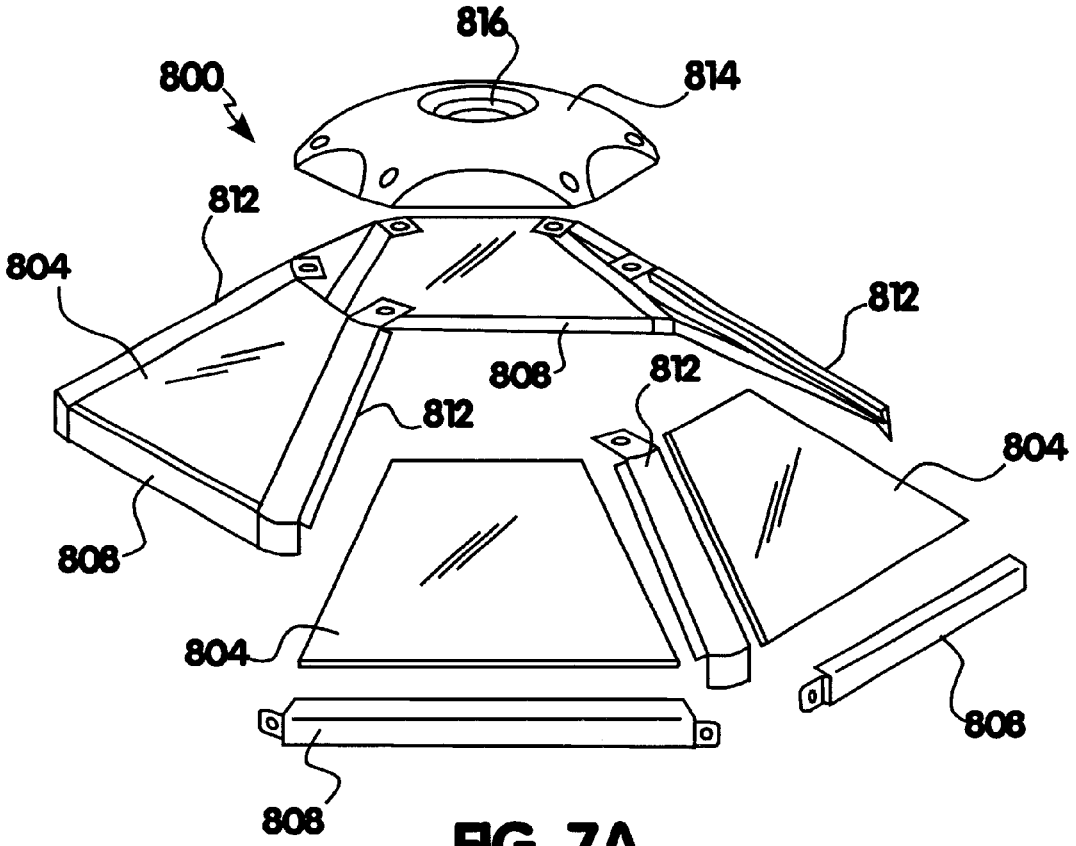
FIG. 7*a* illustrates a heat reflector of a heater according to another embodiment of the present invention, partially set-up.

FIG. 7*a* illustrates a heat reflector of a heater according to another embodiment of the present invention, partially set-up. Referring to FIG. 7*a,* the heat reflector 800 includes, for example, six panels 804, six outer frame members 808, six inner frame members 812, and a central mounting disk 814. Other numbers of panels and frame members may be used. The frame members 808 and 812 attach to each other and to the disk 814, preferably by screws or nuts and bolts. The frame members 808 and 812 and the disk 814 may attach by other methods, such as friction fit. Each outer frame member 808 includes a slot for holding one of the panels 804. Each inner frame member 812 includes two slots for holding two adjacent panels 804. The disk 814 includes an opening 816 for mounting to a heater.

Figure 7B:
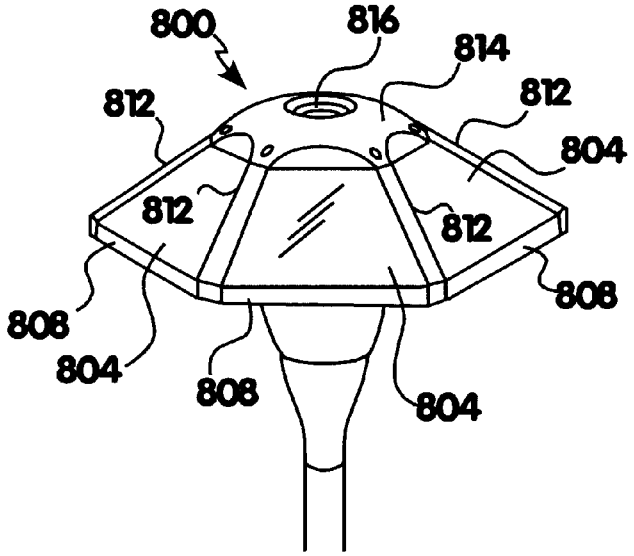
FIG. 7*b* illustrates the heat reflector of FIG. 7*a,* fully set-up and mounted to a heater.

Preferably, each panel 804 is manufactured from decorative, heat resistant glass and includes a reflective coating which faces the heating and lighting elements of the heater when the heat reflector is set-up and mounted to a heater. Preferably, each of the frame members 808 and 812 is formed from aluminum or steel, and preferably the disk 814 is steel. The elements of the heat reflector 800 may be formed from other suitable materials. FIG. 7*b* illustrates the heat reflector of FIG. 7*a,* fully set-up and mounted to a heater. When set-up, the heat reflector 800 may be mounted to a heater by fitting the opening 816 over an extension on the top of the heater; the extension may attach to the heat reflector 800 by friction fit, by being screwed on, or by other methods. The heat reflector 800 is preferably generally convex; if the panels 804 are flat the shape of the heat reflector 800 may come from the frame members 808 and 812.

In a further embodiment, the heat reflector includes a set of panels, where all the panels are connected at a single pivot point. The panels may rotate and slide with respect to each other at the pivot point. Preferably, each panel represents a portion of a circular disk or polygon. Each panel may be convex, so that the heat reflector may also be convex, or may be flat. When the panels are slid or rotated in a certain configuration the panels form the circular disk or polygon, and when the panels are slid or rotated in a second configuration the panels rest on top of one another to have the silhouette of the shape of one of the panels. Preferably, the pivot point is at the center of the disk or polygon. The disk or polygon may be joined to the top of a heater to form a heat reflector. The edges of each panel may include indentations, ridges or stamped detents to hold the panels in open and closed positions.

Figure 8A:
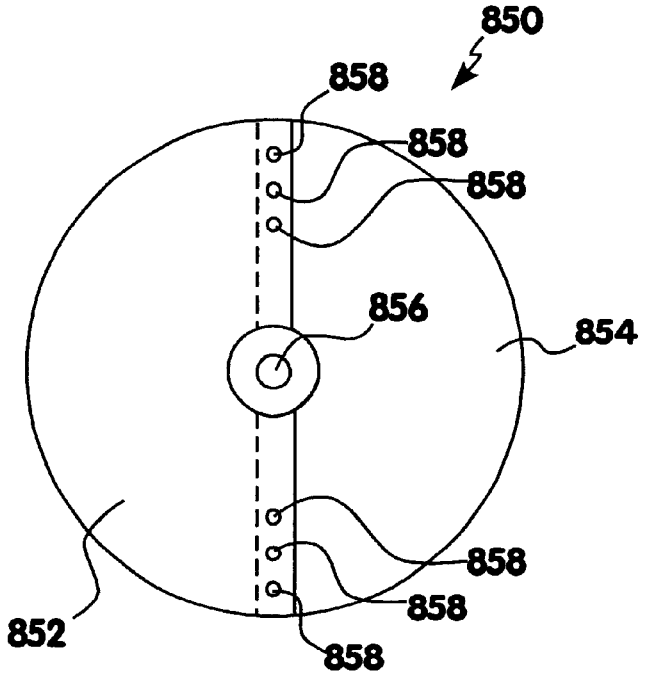
FIG. 8*a* illustrates a heat reflector of a heater according to another embodiment of the present invention, where the heat reflector is fully opened.

FIG. 8*a* illustrates a heat reflector of a heater according to another embodiment of the present invention, where the heat reflector is fully opened. Referring to FIG. 8*a,* the heat reflector 850 includes two panels 852 and 854, each forming slightly more than one half of a circle. Panels 852 and 854 are joined at a pivot point 856. Each panel 852 and 854 is preferably slightly convex. Each panel 852 and 854 may also include stamped indentations 858 at its inner edge. When the panels 852 and 854 are open, the stamped indentations 858 nest to hold the panels 852 and 854 in an open position, and when the panels 852 and 854 are closed, the stamped indentations 858 hold the panels 852 and 854 closed. Other methods may be used to hold the panels open; for example latches or ridges. Other numbers of panels may be used.

Figure 8C:
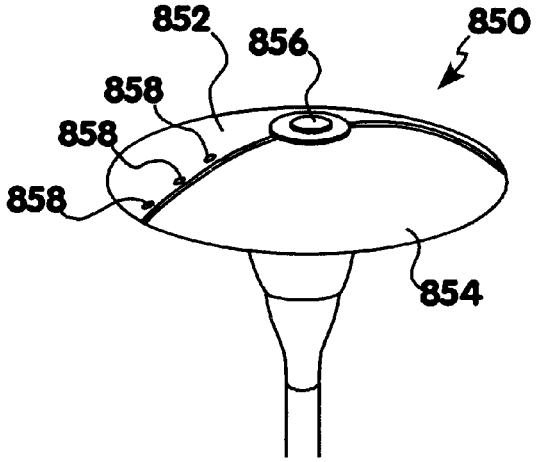
FIG. 8*c* illustrates the heat reflector of FIG. 8*a,* where the heat reflector is mounted to the heater.
Figure 8B:
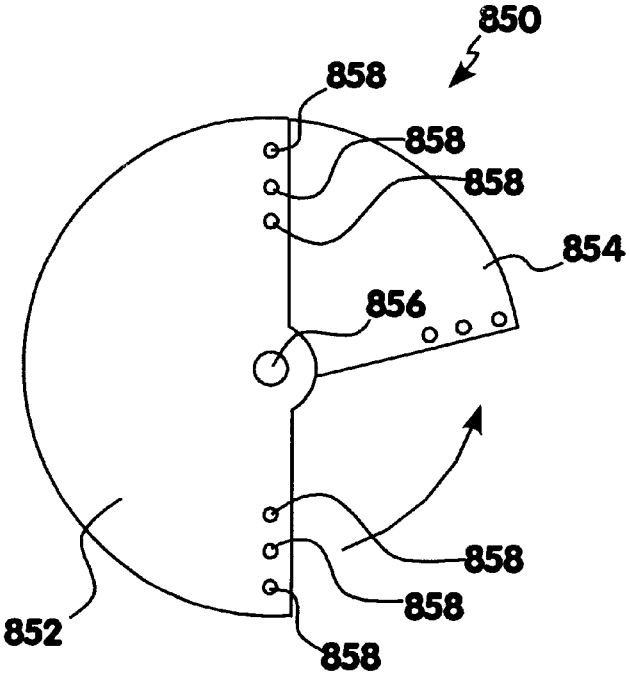
FIG. 8*b* illustrates the heat reflector of FIG. 8*a,* where the heat reflector is partially closed.

FIG. 8*b* illustrates the heat reflector of FIG. 8*a,* where the heat reflector is partially closed. Referring to FIG. 8*b,* the panel 852 can be seen sliding underneath the panel 854 to form a more compact heat reflector. FIG. 8*c* illustrates the heat reflector of FIG. 8*a,* where the heat reflector is mounted to the heater. When opened, the heat reflector 850 may be mounted to a heater by fitting a mounting hole in the heat reflector 850 over an extension on the top of the heater; the extension may attach to the heat reflector 850 by friction fit, by being screwed on, or by other methods.

In a further embodiment, the heat reflector includes a set of panels which fit together to form the entire heat reflector. Preferably, each panel represents a portion of a circular disk or polygon; for example, each panel may represent a strip of the heat shield. Each panel may be convex, so that the heat reflector may also be convex, or may be flat. The panels may connect to each other by, for example, snapping together or by screws. The disk or polygon may be joined to the top of a heater to form a heat reflector.

Figure 9A:
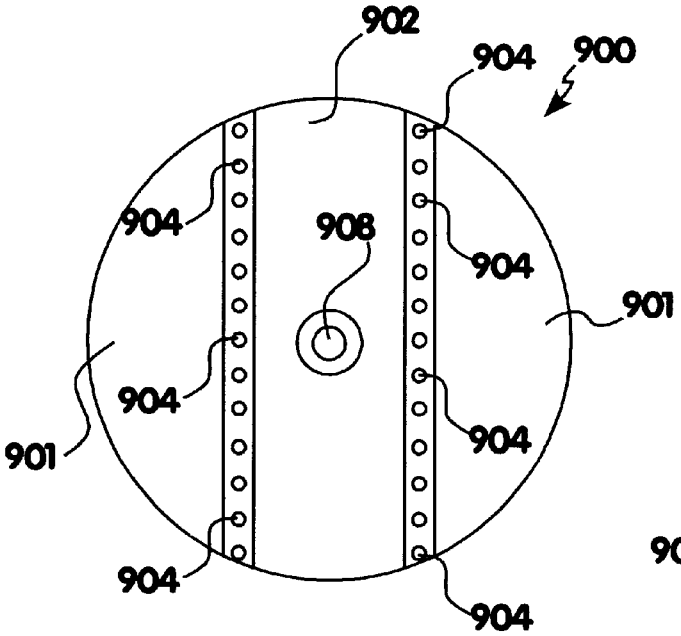
FIG. 9*a* illustrates a heat reflector of a heater according to another embodiment of the present invention, where the heat reflector is set-up.
Figure 9B:
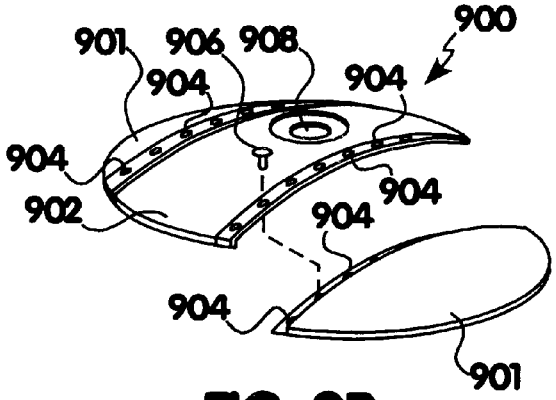
FIG. 9*b* illustrates the heat reflector of FIG. 9*a,* partially set-up.
Figure 9C:
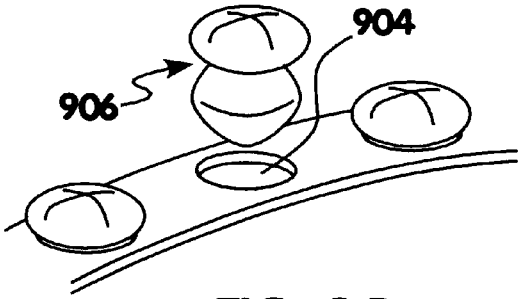
FIG. 9*c* illustrates the use of a snap connector of the heat reflector of FIG. 9*a.*
Figure 9D:
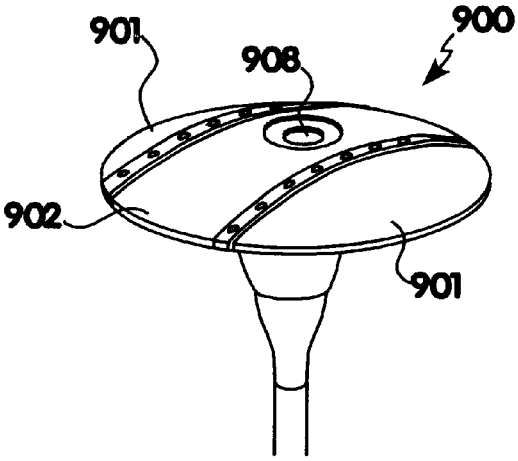
FIG. 9*d* illustrates the heat reflector of FIG. 9*a,* fully set-up and mounted to a heater.

FIG. 9*a* illustrates a heat reflector of a heater according to another embodiment of the present invention, where the heat reflector is assembled. Referring to FIG. 9*a,* the heat reflector 900 includes two edge panels 901 and one middle panel 902. Each panel 901 and 902 forms, for example, part of a circle, and is preferably shaped to be slightly convex. Each panel 901 and 902 includes snap holes 904 at the edge where it joins an adjacent panel 901 or 902. FIG. 9*b* illustrates the heat reflector of FIG. 9*a,* partially assembled. FIG. 9*c* illustrates the use of a snap connector of the heat reflector of FIG. 9*a.* Referring to FIGS. 9*b* and 9*c,* a set of snap connectors 906 enter the snap holes of the panels 901 and 902 to join adjacent panels 901 and 902. Other types of connectors or connecting methods may be used; for example, screws or bolts. When assembled, the heat reflector 900 may be mounted to a heater at a mounting hole 908 located in the center panel 902. The heater may include an extension on the top of the heater; the extension may attach to the heat reflector 900 by friction fit, by being screwed on, or by other methods. FIG. 9*d* illustrates the heat reflector of FIG. 9*a,* fully assembled and mounted to a heater.

In a further embodiment, the heat reflector includes a set of fins hinged to a set of connectors. The connectors are arranged, for example, in a circle or polygon, and the fins extend out radially. When the heat reflector is in its un-set-up, compressed form, the connectors open to cause the fins to compress and line up in a generally parallel orientation. To open the reflector to its full size, the connectors close and form a ring, forcing the fins to spread and form the circle or polygon of the heat shield. The fins may pivot with respect to the connectors. Each connector may include a rib fixed to the connector for aiding in spreading and compressing fins, and to add structural support. The fins may have catches or raised portions to limit the extent to which they may spread and to prevent gaps or holes from forming in the fully opened heat reflector. The fins may be curved or bent so that the heat reflector has a concave shape.

Figure 10A:
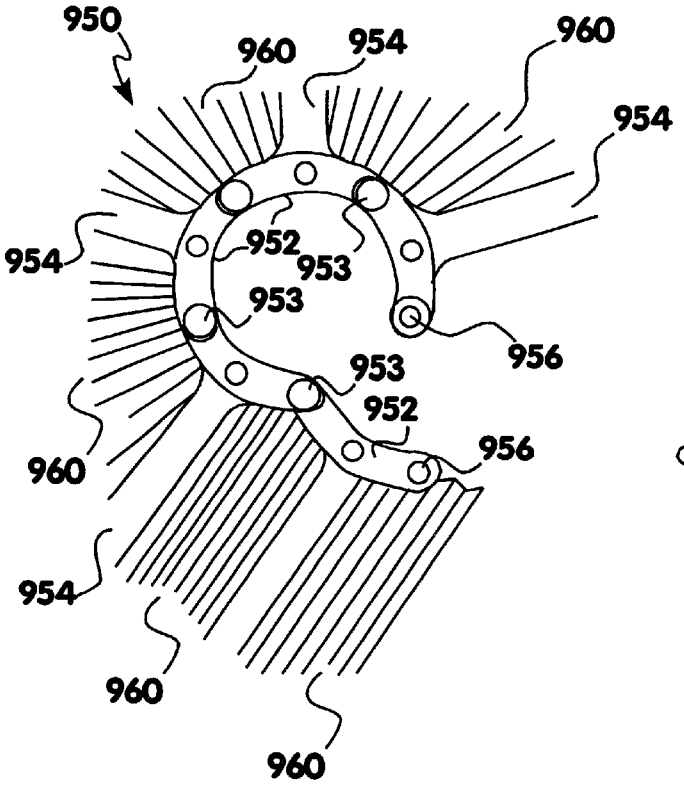
FIG. 10*a* illustrates a portion of a heat reflector of a heater according to another embodiment of the present invention.
Figure 10E:
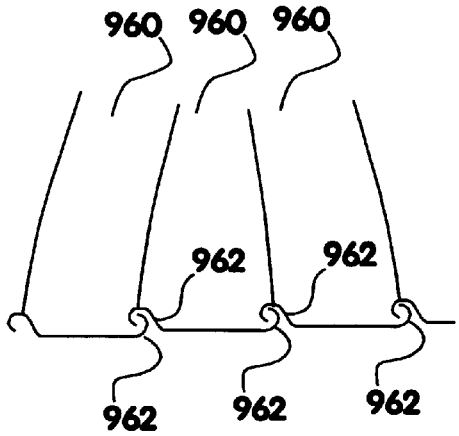
FIG. 10*e* depicts a portion of the fins of the heat reflector of FIG. 10*a.*

FIG. 10*a* illustrates a portion of a heat reflector of a heater according to another embodiment of the present invention. Referring to FIG. 10*a,* the heat reflector 950 includes a set of base connectors 952, each connector including a fixed rib 954 extending from the connector. When the heat reflector 950 is fully set up each rib 954 extends in a preferably radial direction. The connectors 952 may be straight, or may be curved so that the plurality of connectors 952 may form a circle; the connectors 952 may be other shapes. Preferably, each connector 952 is pivotably connected to an adjacent connector 952 by a set of pivot points 953; the pivot points may be, for example, rivets. Two end connectors of the connectors 952 may disconnect from each other at a detachable link such as hingeable snap point 956. Thus the connectors 952 may be joined together to form a circle or polygon, and may be opened to form a line of linked connectors 952 as shown in FIG. 10*b.*

A set of fins 960 is pivotably attached to each connector 952. As shown in FIG. 10*b,* two fins 960 on each connector are connected to each side of a rib 954. When the connectors 952 are joined to open and form the heat shield 950, the ribs 954 spread and thus cause the fins 960 to spread out. FIG. 10*e* depicts a portion of the fins of the heat reflector of FIG. 10*a.* Preferably, each fin 960 includes two raised portions or catches 962 which catch on the catches 962 or adjacent fins 960 to control the extent to which the fins 960 may spread. Each fin 960 preferably also preferably increases in width towards the end furthest from its mounting point to a connector 952. FIG. 10*b* illustrates the heat reflector of FIG. 10*a* folded for storage.

Figure 10C:
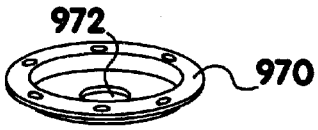
FIG. 10*c* illustrates the center hub of the heat reflector of FIG. 10*a.*
Figure 10B:
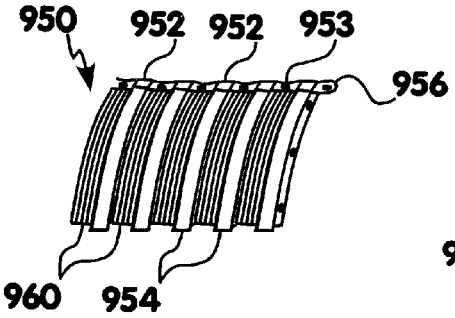
FIG. 10*b* illustrates the heat reflector of FIG. 10*a,* folded for storage.
Figure 10D:
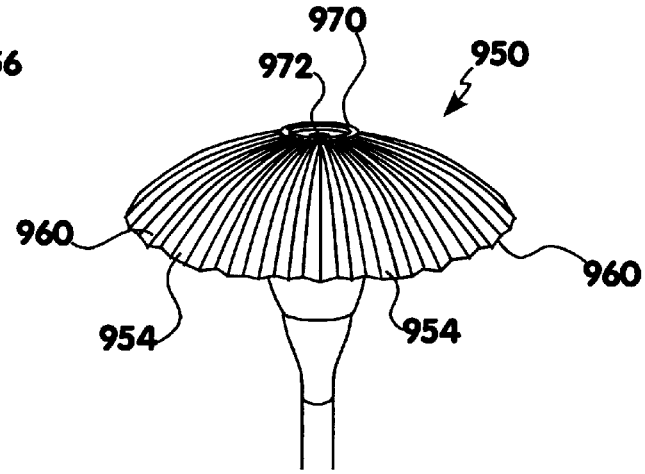
FIG. 10*d* illustrates the heat reflector of FIG. 10*a,* mounted to a heater.

FIG. 10*c* illustrates the center hub of the heat reflector of FIG. 10*a*. Preferably, the heat reflector 950 includes a center hub 970 which attaches to the connectors 952 when the connectors 952 close to form a polygon or circle. The center hub 970 may connect to the connectors 952 via screws, bolts, or other methods. The center hub 970 includes a mounting hole 972, by which the heat reflector may be attached to a heater. FIG. 10*d* illustrates the heat reflector of FIG. 10*a*, mounted to a heater. When assembled, the heat reflector 950 may be mounted to a heater by fitting the hole 972 over an extension on the top of the heater; the extension may attach to the heat reflector 950 by friction fit, by being screwed on, or by other methods. The connectors 952 may be, for example, stainless steel, and the fins may be, for example, pleated metal foil or heat resistant fabric.

While the heater of the present invention is described with respect to specific embodiments, it should be noted that the present invention may be implemented in different manners and used with different applications. The heater according to an embodiment of the present invention may be of a different configuration and may contain different components. For example, no regulator may be included or an alternate ignition system may be utilized. The heater may include a light and a heating apparatus but not include a collapsible or compact heat reflector. Furthermore, the heater may lack a light but include a collapsible or compact heat reflector. While the heater is described as being fueled by flammable gas, the heating apparatus and/or the light may be powered in other ways, such as by liquid fuel or electricity.

What is claimed is:

1. An apparatus for providing heat and light comprising:

a first burner;

a heat reflector disposed above the first burner;

a second burner;

a mantle attached to the second burner and producing light when heated; and a fuel delivery system providing fuel and air to the first burner and to the second burner;

wherein the heat reflector may be removed from the apparatus and compacted.

2. The apparatus of claim 1 wherein the mantle includes a catalyst.

3. The apparatus of claim 1 wherein the fuel delivery system includes a regulator.

4. The apparatus of claim 3 wherein the fuel delivery system includes a fuel cylinder.

5. The apparatus of claim 4 comprising a clear panel disposed around the second burner.

6. The apparatus of claim 1 wherein the fuel delivery system comprises:

a first adjustable valve providing a controlled fuel flow to the first burner; and a second adjustable valve providing a controlled fuel flow to the second burner.

7. The apparatus of claim 1 comprising a mesh disposed adjacent to the first burner, wherein heating of the mesh by the first burner provides radiant heat.

8. The apparatus of claim 1 wherein the heat reflector is removable and comprises:

a plurality of panels, each panel including:

a flat portion; and three edge portions, wherein downwardly extending projections extend downward from two of the three edge portions wherein the plurality of panels may be joined at their respective edge portions to form a heat reflector, and wherein the heat reflector may be set-up for use and disassembled for compact storage.

9. The apparatus of claim 8 wherein, when the plurality of panels is joined to form a heat reflector, each downwardly extending projection is joined to the downwardly extending projection of an adjacent panel.

10. The apparatus of claim 9 wherein adjacent downwardly extending projections are joined by friction fit tabs.

11. The apparatus of claim 1 wherein the heat reflector is removable and comprises:

a flat disk; and a plurality of panels, each of the plurality of panels hingedly attached to the flat disk, wherein the heat reflector may be expanded for use.

12. The apparatus of claim 1 wherein the heat reflector is removable and comprises:

a plurality of panels, each of the plurality of panels including a flat portion and three edge portions; and a frame surrounding and holding each of the plurality of panels, wherein the heat reflector may be set-up for use and disassembled for compact storage.

13. The apparatus of claim 1 wherein the heat reflector is removable and comprises:

a first panel having a shape of a portion of a disk; and a second panel having a shape of the portion of a disk;

wherein the first panel and the second panel are slidably connected at a pivot point, and wherein the heat reflector may expand for use.

14. The apparatus of claim 1 wherein the heat reflector is removable and comprises:

a plurality of panels, each of the plurality of panels comprising a portion of a concave disk and connecting to a set of adjacent panels via a snap connection, wherein the heat reflector may be set-up for use and disassembled for compact storage.

15. The apparatus of claim 14 wherein the heat reflector comprises a set of snap connectors.

16. The apparatus of claim 1 wherein the heat reflector is removable and collapsible and comprises:

a plurality of base connectors, each base connector pivotably connected to two adjacent base connectors, two end base connectors of the plurality of base connectors pivotably connected to each other at a detachable link; and a plurality of fins pivotably extending from the plurality of base connectors, wherein when the end base connectors connect the fins are spread to form a disk.

17. The apparatus of claim 16 comprising:

a rib fixed to each base connector, each rib functioning to spread the plurality of fins when the end base connectors connect.

18. An apparatus for providing heat and light comprising:

a base member;

a support member;

a burner disposed in an upper portion of the support member;

a heat reflector disposed above the burner;

a light disposed in an upper portion of the support member; and a fuel delivery system providing fuel and air to the first burner;

wherein the heat reflector may be removed from the apparatus and be compacted.

19. The apparatus of claim 18 wherein the light comprises an electric light.

20. The apparatus of claim 18 wherein the light comprises a gas burner.

21. The apparatus of claim 18 wherein the fuel delivery system includes a regulator.

22. The apparatus of claim 18 comprising a mesh adjacent to the burner, wherein heating of the mesh by the burner provides radiant heat.

23. The apparatus of claim 18 wherein the heat reflector is removable and may be compacted.

24. The apparatus of claim 18 wherein the heat reflector is removable and comprises a plurality of panels.

25. The apparatus of claim 24 wherein the plurality of panels connect to one another using removable connectors.

26. An apparatus for providing heat comprising:

a base member;

a support member;

a burner disposed in an upper portion of the support member;

a heat reflector disposed above the burner, wherein the heat reflector may be removed from the apparatus and made compact; and a fuel delivery system providing fuel and air to the burner.

27. The apparatus of claim 26 wherein the heat reflector comprises a plurality of panels, each panel including:

a flat portion; and three edge portions, wherein projections extend downward from two of the three edge portions, wherein the plurality of panels may be joined at their respective edge portions to form a heat reflector, and wherein the heat reflector may be set-up for use and disassembled for compact storage.

28. The apparatus of claim 27 wherein, when the plurality of panels is joined to form a heat reflector, each projection is joined to the projection of an adjacent panel.

29. The apparatus of claim 28 wherein adjacent projections are joined by friction fit tabs.

30. The apparatus of claim 26 wherein the heat reflector comprises:

a flat disk; and a plurality of panels, each of the plurality of panels hingedly attached to the flat disk, wherein the heat reflector may be expanded for use.

31. The apparatus of claim 26 wherein the heat reflector comprises:

a plurality of panels, each of the plurality of panels including a flat portion and three edge portions; and a frame surrounding and holding each of the plurality of panels, wherein the heat reflector may be set-up for use and disassembled for compact storage.

32. The apparatus of claim 26 wherein the heat reflector comprises:

a first panel having a shape of a portion of a disk; and a second panel having a shape of the portion of a disk;

wherein the first panel and the second panel are slidably connected at a pivot point, and wherein the heat reflector may expand for use.

33. The apparatus of claim 26 wherein the heat reflector comprises:

a plurality of panels, each of the plurality of panels comprising a portion of a concave disk and connecting to a set of adjacent panels via a snap connection, wherein the heat reflector may be set-up for use and disassembled for compact storage.

34. The apparatus of claim 33 wherein the heat reflector comprises a set of snap connectors.

35. The apparatus of claim 26 wherein the heat reflector comprises:

a plurality of base connectors, each base connector pivotably connected to two adjacent base connectors, two end base connectors of the plurality of base connectors pivotably connected to each other at a detachable link; and a plurality of fins pivotably extending from the plurality of base connectors, wherein when the end base connectors connect the fins are spread to form a disk.

36. The apparatus of claim 35 comprising:

a rib fixed to each base connector, each rib functioning to spread the plurality of fins when the end base connectors connect.

* * * * *